US005451023A

United States Patent [19]

Johnston

[11] Patent Number: 5,451,023

[45] Date of Patent: Sep. 19, 1995

[54] HOLSTERED HANDGUN RETAINER

[76] Inventor: James R. Johnston, 620 Bedford Oaks Dr., Kirkwood, Mo. 63122

[21] Appl. No.: 180,369

[22] Filed: Jan. 12, 1994

[51] Int. Cl.[6] ..... A47G 1/10

[52] U.S. Cl. ..... 248/316.7; 248/300; 248/903

[58] Field of Search ..... 248/316.7, 316.1, 309, 248/300, 903; 5/503.1; 224/243, 244, 912

[56] References Cited

U.S. PATENT DOCUMENTS

| | | | |
|---|---|---|---|
| 4,044,930 | 8/1977 | Petroski | 248/309.1 X |
| 4,974,804 | 12/1990 | Thompson et al. | 248/316.7 |
| 5,236,113 | 8/1993 | Wisser | 224/943 |

*Primary Examiner*—Ramon O. Ramirez
*Attorney, Agent, or Firm*—Paul M. Denk

[57] ABSTRACT

A retainer for holding a holstered handgun to a surface, such as a wall, under a shelf, or the like, the retainer comprising a bracket, formed having upper and lower legs, and being integrally bent at one end, so that the legs may extend generally parallel with respect to each other, for approximately equivalent lengths, and with the curvature of the bend being sufficient to provide adequate clearance within the bracket for retention of the strap of a holster therein. The legs of the bracket may be grooved, to provide inherent reinforcement and strength to it, during usage. The opposite or free ends of each leg are bent, to initially form shoulders against which the strap of the holster may encounter, so as to prevent its untimely release, while at the same time these bends contact each other, under a spring bias, to assure that the bracket remains closed, for retention of the holster thereto, when stowed. The lower leg, beyond its free end being bent, and provides an extension for resting against the surface to which the bracket is secured. The upper leg, beyond its bend, includes a flared flange, which functions as a guide to facilitate the insertion of the srap of a holster thereon, and for sliding therethrough, when the holster is installed, for stowage, or to facilitate gripping and raising of the leg, to furnish an opening therebetween, to ease the removal of the holster from the retainer, when the revolver is desired for usage.

11 Claims, 2 Drawing Sheets

HOLSTERED HANDGUN RETAINER

BACKGROUND OF THE INVENTION

This invention relates to a stashing device for use by the owner of a bolstered handgun, whether it be the policeman, the homeowner that possesses one or more handguns, or others, or by other law enforcement officers, security guards, the military, storekeepers, or the like, where it is necessary to provide for secure and confidential stowage of the handgun, as when not in use, but have it maintained readily accessible in the event that an emergency condition requires its ready removal, or to provide a location where the device can be secured, overnight, as when not in use.

There are a number of products, of the stashing or storage type of devices, offering quick access storage, as for use for accommodating handguns. Several types of locking strong boxes, as for locking guns when not in use, are available, and while they do provide for secure storage of the pistol or revolver when not in use, do not lend themselves to quick access, as when required under an emergency condition. Usually, such type of storage means are available only in predetermined sizes, they are not easily concealable as desired, and normally draw attention or are cumbersome with regard to storage, due to their appearance, and give the impression that they may contain something of value, particularly since a locking mechanism may be disclosed upon its surface structure.

Another type of storage device may be the use and application of the wood or plastic dowel, which may be secured into some mountable base, such as a wall, shelf, or other place, and upon which the barrel of the revolver may insert, or have the dowel inserted therein, or upon which the strap of a holster may secure. But, these types of securing means are dangerous with respect to the stowage of a revolver, particularly when they may be loaded, since its means of suspension is not very stable, and the revolver can easily pivot, during storing, or when removed, which may be undesirable from a safety standpoint. Furthermore, it is quite easy and such has frequently occurred where removal of the handgun from the dowel may result in an authorized or inadvertent discharge, as when the revolver is being removed from the dowel, which can cause not only a stressful situation, but very potential danger, even of the deadly type, to anyone in the vicinty.

Another device for use for storing of a revolver is of the picture frame type, that is designed to accommodate the mounting of a handgun inside the frame. The picture frame is hinged to its backing and secured in a closed position by a catch and release means, that allows for easy opening and exposing of the revolver, and provides for its ready accessibility by anyone, within its vicinity. The disadvantages of this type of device are that it is visually apparent by its thickness to provide the required space within a picture frame, thereby attracting curious attention, of the type that is undesired particularly by any children that may be located in the residence, or which may be behind the counter in a store, where such a revolver may be confined and secured. And, if the picture frame type of device is mounted too high, when it is opened, it is likely the revolver can fall free, which can provide for its untimely discharge, much to the hazard of its nearby owner.

The inventor is of the impression that a off-the-person type of stashing device for use for holstered handguns, and their storage, while at the same time providing for their rapid access, and removal, as required, really has not been devised in the art.

It is, therefore, an object of the present invention to provide a storage means for a handgun that incorporates a bracket that furnishes, during stowing of the holstered revolver, in a particular orientation for it, normally one where the revolver is pointed always in a safe direction, so as to assure that firm locating of the unused revolver may be assured, and at the same time providing for safety during its stowage.

Another object of this invention is to provide a bracket means that is fabricated as an integral item, may be readily and firmly secured to a supporting surface, but easily manipulated simply by sliding the strap of a holster into position for insertion within the bracket, for its secure retention, as when not in use.

Still another object of this invention is to provide a bracket that readily facilitates the removal of the holstered revolver, as it is desired to remove it for use by the user, as when he/she must enter on duty.

Yet another object of this invention is to provide for the maintenance of control and improved safety with the storing of a holstered handgun, through the usage of a bracket of this design.

Yet another object of this invention is to provide a bracket for use for stowing a bolstered handgun in a secure position, and to protect the gun from damage.

Still another object of this invention is to provide for means for improving the margin of safety to the user and to those in the vicinity from accidental discharge of a gun when the bolstered revolver is being stowed, or removed therefrom.

Still another object of this invention is to provide for ready access to a revolver from its stowed position.

Still a further object of this invention is to provide for a reduced possibility of accidents from unauthorized access or handling of unholstered guns.

Yet another object of this invention is to provide for the convenient and single handled mounting and dismounting of a bolstered handgun, from the bracket of this invention.

Still another object of this invention provides for the rapid single handed withdrawal of the gun from its mounted holster, and supporting bracket.

Yet another object of this invention is to provide for a bracket for holding a bolstered handgun and which can be quickly relocated and reattached in a minimum of time through the exertion of a small amount of effort.

A further object of this invention is to provide for virtual unlimited attachment options, for allowing a mounted revolver to be secured for stowage in any direction, but particularly one where it is always pointed in a safe direction.

Yet another object of this invention is to provide for a bracket for securement for stowage purposes of a bolstered handgun, such as to facilitate its mounting within a closet, on a wall, spaced over a door, or elsewhere, as behind clothing, inside a cabinet, as positioned out of view, upon the underside of a shelf, desk, counter or tabletop, on a wall behind drapery, tapestry, or wall hanging, or even behind a bedboard, bureau, dresser, or the like.

SUMMARY OF THE INVENTION

According to this invention, there is provided a bracketed stashing device, formed from a single piece of preferably tempered steel, of a desired gauge, dimensions, shape, and the like, being formed into the configuration of a dual legged device, being bent at a radius at one end, and having a pair of free ends at the opposite edge thereof. When the bracket is attached to a hard surface, such as a wall, shelf, or the like, as aforesaid, it will function as a mounting and dismounting device for a holstered handgun. The device will impart sufficient gripping action and stability to the securement of the holstered handgun, particularly through retention of the strap provided laterally of the holster, so as to allow for its rapid application and insertion to the bracket during gun stowage, but also to provide for its quick and facile extraction from the bracket, or even the gun from just its holster, as may be desired. As stated, the device is formed from a flat length of metal, being bent at approximate its midpoint to form a pair of legs, normally arranged in a parallel and horizontal condition, with the leg of the bracket that is intended to be secured directly against a surface having one or a pair of small apertures therein, and into which a fastener, such as a screw, like a wood screw, can insert through and be tightened, thereby stabily binding that leg and the entire bracket to a wall, or the like. To provide for the convenience of locating of the screw through the back leg of the bracket, the horizontally arranged upper or exposed leg may have larger sized apertures provided therethrough, in alignment with the apertures of the back leg, with said front leg apertures being enlarged, i.e., greater than the dimension or diameter of the head of the securement screws, so that they can be threaded directly through the front leg, and thereby tightly bind the back leg and the entire bracket to the wall, when secured.

At the opened end of each leg, they are bent into a configuration to provide for, initially, with respect to the back leg, a lip or raised portion that functions to secure the holster strap within the bracket, and to prevent its slippage or removal, while the front leg of the bracket is also bent rearwardly, towards the back leg, so as to contact particularly in alignment upon the raised portion of the said back leg, to form, generally, a barrier that prevents the undesired slippage or removal of the bolstered gun, and more particularly its strap, from the bracket during gun stowage. In addition, the bent portion of the front leg further includes an integral extending flange, which is flared outwardly, and which functions as a guide for the holster strap as it is slid onto and within the bracket, between its legs, during securement of the bolstered handgun. The angle and length of this flared flange is such that, in the mounting action, it functions to provide a guiding effect for initiating the insertion of the holster strap or loop. When a full insertion of the holster loop is made onto the bracket, beyond the raised and bent portions of the various bracket legs, they provide for means for securement of the strap of the holster securely within the bracket, thereby firmly retaining it in place, regardless of the attachment positioning. For example, if the opening between the legs of the bracket are directed downwardly, these bent components of the bracket provide a shoulder that yet prevents the holster from slipping out of the bracket, once it is secured therein, unless the user firmly grasp the flange of the outer leg, holds it open, so as to allow for clearance for sliding removal of the strap of the holster therefrom, as when the holstered gun is being removed for application.

Furthermore, n order to facilitate and maintain some degree of tightness between the integral bracket legs, the device may be formed, as previously explained, from a form of tempered steel, having a spring biasing action inherent in it, of sufficient strength to hold the legs together, and support the retention of the holstered handgun, through its strap, therein, when the revolver is stowed.

BRIEF DESCRIPTION OF THE DRAWINGS

In referring to the drawings, FIG. 1 provides an isometric view of a holstered handgun, disclosing its strap secured within its bracket, as attached to a supporting wall.

DESCRIPTION OF THE PREFERRED EMBODIMENT

Figure 1:
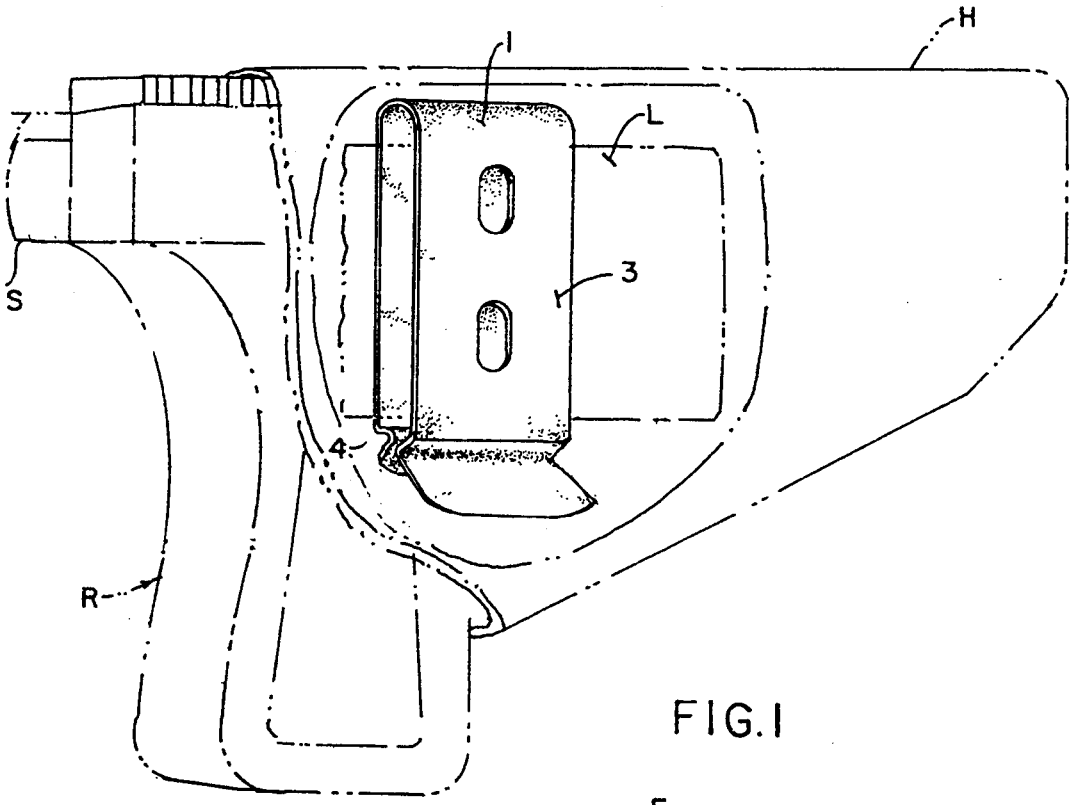
Figure 2:
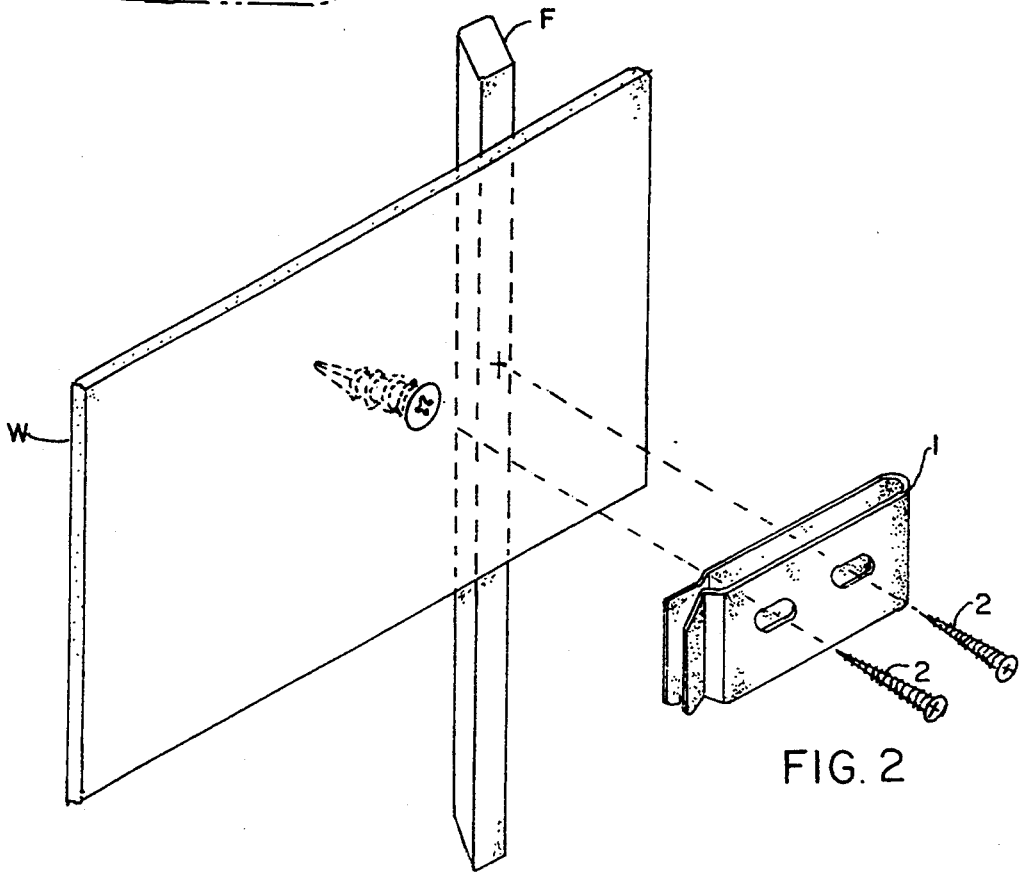
FIG. 2 shows the bracket, independent of the holstered handgun, in the condition of being installed upon a wall, with its various screws being secured either through the wall, and into the stud work, to secure the bracket firmly in place.

In referring to the drawings, and in particular FIG. 1, the bolstered hand gun retainer of this invention is generally disclosed. As can be seen, the revolver is normally held within its holster H, and includes a hammer strap S that retains the revolver within its holster. On the backside of the holster, as can be seen through the cutaway section provided within this figure, the holster normally includes a length of strap or loop L, which is generally secured at its upper and lower ends, as noted, with the purpose of this particular strap normally being to accommodate the belt of the user, so that the holster can be supported upon the owner, during application and usage. It is in conjunction with this particular strap L that the retaininer in this invention is utilized. As can be seen, the retainer 1 is disposed for accommodating the strap L therein, so as to secure the holstered handgun to whatever surface the owner desires to provide for storage, concealment, or general retention of the revolver, particularly during nonusage. As previously alluded to, the retainer may be secured against a wall, such as shown in FIG. 2, where the bracket 1 is held by a series, being one or more, of fasteners, such as the wall board anchors, threaded screws 2, to the wall W, and perhaps applying one of the screws into the stud structural framework F of the wall, to provide firm securement thereto. As can be seen in FIGS. 1 and 2, in addition to FIGS. 3 and 5, the bracket 1 is formed having a pair of integrally formed legs 3 and 4, the upper leg provided at 3, and the lower or base leg provided at 4, and it is the leg 4 that is secured generally flush against the wall or other supporting structure, when installed, in the manner as previously reviewed in the summary of this invention. A bend 5 is furnished integrally at one end between the legs 3 and 4, and furnishes sufficient clearance between the legs, so as to accommodate the strap L of differing sizes that may need to be accommodated by this bracket, when retaining the holstered handgun against the shown surface. Furthermore, as can be seen, there may be integral grooves 6 provided and stamped within the structure of the bracket 1, in order to add further structural strength to the bracket, during its usage and application.

At the opposite end, as at 7, for the bracket, each leg is bent into a particular configuration to achieve a specific result. For example, the lower leg 4 is bent to form an upturned portion, as at 8, and then is continued in its extension outwardly, as at 9, as can be seen. The purpose of this upturned portion 8 is to form a shoulder, as at 10, against which the strap L will engage, should it slide to this position within the bracket, so as to prevent the untimely removal of the bolstered handgun, from the bracket, until such time as it is actually desired to remove the same. The upper leg 3 is likewise bent downwardly, as can be seen at 11, and the purpose of the downward bend is to provide a contacting surface, as at 12, that engages the upturned portion 8, of the lower leg, to afford a form of abutting closure, at this location, and once again, to prevent the untimely removal of the bolstered handgun from the bracket, once stowed. At this juncture the upper leg incorporates an integral flange, as at 13, that is flared upwardly, and the purpose of this flange 13, in addition to the extension 9, can be summarized as follows. The extension 9, of the lower leg 4, is designed to rest snuggly against the wall, shelf, or other surface, to which this retainer is applied. Thus, the strap of the holster will freely slide thereover, as it is being inserted into and engaged within the formed bracket. The upper flange 13, of the leg 3, flares upwardly, as can be noted, away from the lower extension 9, and in this manner provides a form of guide to the holster strap as it commences its insertion between the legs 3 and 4, of the bracket, during its installation. Thus, the upward flaring of the flange 3 is to provide a form of guidance for engagement with the strap L of the holster into the bracket, as during its initial insertion and installation.

Figure 5:
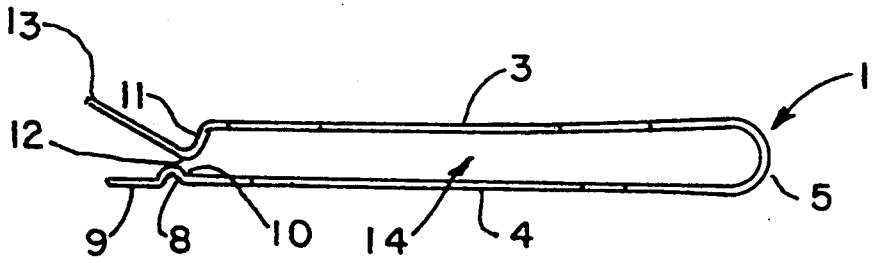
FIG. 5 is a side edge view of the bracket of FIG. 3.

It needs to be mentioned herein, again, as previously reviewed, that the bracket 1 is formed preferably of a tempered steel, or perhaps even of a plastic, and includes a certain degree of inherent tensioning, so that when it is at rest, as shown in FIG. 5, the surfaces 8 of the lower leg 4, and the portion 11, of the upper leg 3, bias against each other with some degree of force, to function as a retention means for holding these two components together, and to assure that the space 14 within the brackets acts as significant confinement for holding the holstered handgun in place, once stowed. On the other hand, by simply pulling upwardly upon the flange 13, or once the flange 13 engages under the strap L, between its holster, the holster may be lifted slightly, to lift the leg 3 with respect to the leg 4, thereby providing a space at the vicinity 12, to allow for the strap L to slide within the bracket, and to be retained therein, during installation of the holster. Once located therein, the shoulders 10 and 11 engage under some degree of bias, and function as a stop or shoulder to prevent the untimely release of the holster, or its strap L, from within the retainer. But, when it is desired to remove the holstered handgun from the bracket, the operator simply need to lift upwardly upon the flange 13, until such time as sufficient clearance is provided at the region 12, and at this time the strap L can freely shift within said space, clear the various shoulders 10 and 11, to provide for the quick and safe removal of the holster, and its handgun, from the retention bracket.

Figure 4B:
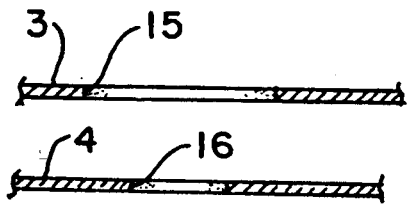
FIGS. 4A and 4B is a sectional view of a part of the bracket.
Figure 4A:
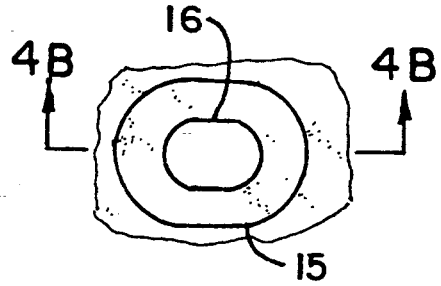
Figure 3:
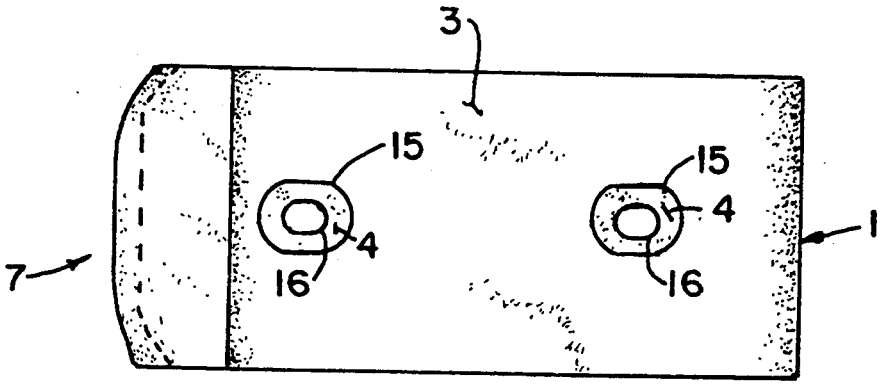
FIG. 3 is a top view of the bracket, showing its upper leg with its enlarged apertures therethrough, and likewise showing the smaller apertures of the back leg that facilitate the tightening of this bracket to a supporting surface through the use of wood screws or other fasteners.

As can also be seen in FIG. 3, in addition to FIG. 4, the various apertures provided through the upper and lower legs 3 and 4, respectively, are of differing sizes, and for the following reason. The aperture(s) provided through the upper leg 3, as can be noted at 15, are of a somewhat elongated shape, and much larger than the apertures 16 provided through the lower leg 4. The reason for this is to facilitate the connection of the retainer to a wall or other surface, and it is necessary to provide full clearance for the head of the screws 2 to pass through the upper plate, as they are being fastened to a wall or other structure. On the other hand, the desired head of the screw 2 will be larger than the aperture(s) 16 provided through the lower leg 4, so that the head of the screw will bind the lower leg 4 directly against the surface to which it is mounted, to furnish its securement to the desired supporting structure. Otherwise, it would be most difficult to provide means for securement of the bracket of this retainer to a surface, unless a means is provided to allow the fastening means, such as the screws 2, to directly mount the lower leg against a surface, for permanent installation. It is likely, as an equivalent, that various ears or tabs (not shown) could be formed of lower leg, as for example, extending laterally therefrom, and have apertures provided therethrough, for securement of that leg 4, and the entire bracket, to a surface, during its installation. This is an example of an equivalent method and structure for securement of this retainer to a wall, shelf, or the like.

In the installation of this retainer to a surface, initially, the user should set the holster to a desired position either against a wall, on or under a shelf, or other location, where he would like for the holstered handgun to be stowed, as when not in use. Then, a pencil should be applied to mark the corners of the holster's belt strap or loop. After this, the bracket of this retainer should be aligned to the belt loop markings, noting the preferred position for facing of the flange portion of the bracket, that being the opened end, upon which the holster is desired to be inserted when stored. Then, one should mark the center of the two attaching holes that are furnished through the bracket. Following this, using a dry wall anchor, one may carefully center on the mark and screw in the anchor, at that location where the fastener screws are to locate through the bracket. The anchor should be fully seated and flush with the dry wall, or wall surface. Then, positioning the bracket and aligning its holes to the previously inserted dry wall anchors, one may then insert the screws, through the bracket apertures, or holes, and turn and fasten the screws until fully seated against the lower leg apertures, and tighten the entire bracket against the wall. If a wall stud is located behind one or both of the attaching screws, one may use a wood screw only, disregarding the dry wall anchors, and then turn down until the screws are fully seated and tightened against the wall, securing the bracket in place, and ready for usage for accommodating the holstered handgun, during stowage.

Variations or modifications to the subject matter of this invention may occur to those skilled in the art upon review of the disclosure provided herein. Such variations or modifications, if within the spirit of this invention, are intended to be encompassed within the scope of any claims to patent protection issuing upon this development. The description of the preferred embodiment as provided in this application is done so for illustrative purposes only.

Having thus described the invention, what is claimed and desired to be secured by Letters Patent is:

1. A holstered handgun stashing device for use for applying a holstered handgun into a secured stowed position as against a supporting surface, as when said handgun is not in use, wherein the holster for the handgun of the type that incorporates a strap used for application of the holster normally to the belt of its user, comprising, a bracket means, said bracket means formed incorporating a pair of legs, said legs being integrally connected together at one end through a bend, said pair of legs normally being maintained in parallel, and said bracket providing a space between said legs for accommodating a strap, each leg having an opposite end, the opposite end of said legs being free with respect to each other, said bracket and its legs being resilient, the opposite ends of said legs being biased towards each other through the inherent resiliency of the bracket to provide for acceptance of the holster strap therein during stowing, with said holster capable of being eased out of said bracket through a forced opening of said bracket, when access to the handgun is required by its user.

2. The invention of claim 1 wherein said bracket being formed of tempered steel.

3. The invention of claim 1 and wherein said bracket being formed of a polymer.

4. The invention of claim 2 wherein said bracket having a series of apertures provided therein, and fasteners cooperating through said apertures to secure said bracket to a supporting surface.

5. The invention of claim 1 wherein said bracket having a series of apertures provided therein, and fasteners cooperating through said apertures for securing said bracket to a safe and secure location.

6. The invention of claim 5 and wherein each leg has at least one aperture provided therethrough, the aperture of one leg being larger than the aperture provided through the adjacent leg, so as to allow the head of any screw as threadedly engaged through the smaller aperture to fasten said one leg and the bracket to a supporting surface.

7. The invention of claim 6 and wherein said bracket being mounted to a supporting surface, so as to provide for the direction of the bore of a revolver away from its user during its stowage and removal therefrom.

8. The invention of claim 1 wherein each leg of the bracket having at least one integral groove formed therein to structurally reinforce the bracket during usage.

9. A holstered handgun stashing device for use for applying a holstered handgun into a secured stowed position as when not in use, wherein the holster for the handgun of the type that incorporates a strap used for application of the holster normally to the belt of its user, comprising, a bracket means, said bracket means formed incorporating a pair of legs, said legs being integrally connected together at one end through a bend, and provides a space between said legs for accommodating a strap, each leg having an opposite end, the opposite end of said legs being free with respect to each other, said bracket and its legs being resilient, the opposite ends of each leg being biased towards each other through the inherent resiliency of the bracket to provide for acceptance of the holster strap therein during stowing, with said holster capable of being eased out of said bracket through a forced opening of said bracket, when access to the handgun is required by its user, one leg of the bracket rests against a surface to which the bracket is secured, and said leg at its free end having an integral rise provided therein and disposed for contact by a holster strap to prevent an untimely removal of the holster from said bracket.

10. The invention of claim 9 wherein the second leg of the bracket is disposed away and spaced from a supporting surface, and said leg at its free end having a bend formed therein, and a further segment of the bracket forming a flange extending from the bend to facilitate the guidance of a holster strap into the bracket during handgun stowage.

11. The invention of claim 10 wherein said flange is flared to guide the shifting of the holster strap into the bracket for retention of the holstered handgun.

* * * * *